United States Patent [19]

DeBruler

[11] 4,453,525

[45] Jun. 12, 1984

[54] APPARATUS FOR TREATING THE CRANKCASE VAPOR EMISSIONS OF INTERNAL COMBUSTION ENGINES

[75] Inventor: Gregory DeBruler, Seattle, Wash.

[73] Assignee: Energy Innovations, Ltd., Laguna Niguel, Calif.

[21] Appl. No.: 375,726

[22] Filed: May 7, 1982

[51] Int. Cl.[3] ..... F02M 25/06

[52] U.S. Cl. ..... 123/573; 123/572

[58] Field of Search ..... 123/572, 573, 574, 41.86

[56] References Cited

U.S. PATENT DOCUMENTS

| | | | |
|---|---|---|---|
| 1,889,137 | 11/1932 | White | 123/573 |
| 3,241,537 | 3/1966 | Jones | 123/572 |
| 3,246,639 | 4/1966 | Oliver | 123/572 |
| 3,834,365 | 9/1974 | Ussery | 123/572 |
| 3,877,451 | 4/1975 | Lipscomb | 123/573 |
| 3,978,671 | 9/1976 | Gonzalez | 123/572 |
| 4,089,309 | 5/1978 | Bush | 123/573 |

*Primary Examiner*—Ronald H. Lazarus

*Attorney, Agent, or Firm*—Philip D. Junkins

[57] ABSTRACT

Apparatus for treating crankcase vapor emissions of internal combustion engines, particularly automotive engines, interposed between the engine crankcase, ventilation port and the air-fuel intake manifold. The apparatus, including a separator-collector housing with header-cover mounted thereon, is adapted to receive the crankcase emissions (including engine blow-by gases) through the header-cover and an elongated inlet conduit depending downwardly therefrom and to direct such emissions into a lower sludge collection chamber of the housing. A filter assembly is carried by the inlet conduit and spans the separator-collector housing intermediate the bottom of the housing and the header-cover thereby defining in the lower portion of the housing the sludge collection chamber and defining in the upper portion of the housing a recycle vapor chamber. Crankcase vapor emissions entering the apparatus through the header-cover and inlet conduit when discharged into the sludge collection chamber expand therein whereby heavy impurities and components drop out and collect in a pool at the bottom of the housing. The remainder of the emission mixture (including combustible components) is intercepted and strained by the filter assembly during its passage upwardly into the upper recycle vapor chamber of the housing whereby lighter impurities are filtered out of the mixture yielding a purified emission mixture in such upper chamber. The purified emission mixture is passed through an outlet conduit in the header-cover of the apparatus to the air-fuel intake manifold wherein it supplements the engine's fresh supply of air and fuel thereby increasing the efficiency of the engine without adding contaminants to the engine's exhaust gases.

2 Claims, 2 Drawing Figures

APPARATUS FOR TREATING THE CRANKCASE VAPOR EMISSIONS OF INTERNAL COMBUSTION ENGINES

BACKGROUND OF THE INVENTION

1. Field of the Invention

This invention relates generally to apparatus for treating crankcase vapor emissions of internal combustion engines, particularly automotive engines, to improve the efficiency of such engines and to reduce the concentration of unburned hydrocarbons and carbon in the "blow-by" gases from such engines as a pollution control measure.

2. Description of the Prior Art

Automotive internal combustion engines have been identified as the major contributor to air pollution. During the operation of internal combustion engines a small portion of the air-fuel mixture fed to the cylinders of these engines passes by the pistons and piston rings into the crankcase before combustion occurs. Also, after combustion of the air-fuel mixture in the cylinders of internal combustion engines, combustion exhaust gases are forced past the piston rings into the crankcase immediately after combustion takes place. The unburned air-fuel vapor mixture and combustion exhaust gases (including water vapor, oil vapor, carbon dioxide and carbon monoxide) entering the crankcase are collectively called "blow-by" gasses. Blow-by gases are a problem since, if they are permitted to remain in the crankcase, they form various deposits, acids and sludges which are harmful to engine life and performance.

In the past blow-by gases were vented to the atmosphere. However, in recent years concern with air pollution has created a need for preventing crankcase vapors from discharging into the atmosphere. Thus, positive crankcase ventilation (PCV) systems have been developed which recycle engine blow-by gases back into the air-fuel introduction system of the engine and thereafter into the combustion chambers where hydrocarbons in such gases can be combusted.

In order to maintain combustion efficiency a flow control valve has been commonly interposed in the conduit conducting the blow-by gases and vapors from the crankcase to the intake mainfield of the engine. This flow control valve, identified conventionally as a PCV valve, is normally modulated either in relation to the pressure or vacuum in the crankcase or by the amount of vacuum in the intake manifold. With the PCV valve working properly increased milage is experienced because of the return of unburned hydrocarbons to the combustion chambers of the engine.

The PCV valve, which meters the flow of the crankcase emissions, frequently sticks or becomes clogged in one position causing excessive air flow and unbalance in the engine's air-fuel ratio causing rough idling or stalling. If the PCV valve sticks in the other position there is reduced air flow and the blow-by gases are not carried off with the result that the crankcase becomes contaminated with sludge, acid and other harmful products which cause engine corrosion, poor lubrication and (eventually) serious engine damage if the PCV valve is not cleaned or replaced.

Further, the PCV valve is frequently clogged because the crankcase emissions not only are comprised of air and blow-by gases and vapors which pass through such valve, but also contain water and water vapor, oil vapor, resins, varnishes and acids, as well as products of a carbonaceous and calcareous nature. Also, solids such as soot, dust and various oxidation products are present and further tend to interfere with the operation of the PCV valve.

In order to maintain the PCV valve and the engine in good operating condition, it is desirable to separate out and collect the harmful heavy components found in crankcase emissions while permitting the light unburned gaseous hydrocarbons and air to pass through the PCV valve and thence to the intake manifold of the engine.

The patent literature suggests several types of devices which remove at least some of the harmful components found in crankcase emissions and which allow the lighter hydrocarbon components of such emissions to be returned to the engine for combustion therein. U.S. Pat. No. 3,463,132 to W. S. Krieck, U.S. Pat. No. 3,779,221 to J. J. Gartner, and U.S. Pat. No. 4,089,309 to E. M. Bush all disclose and claim apparatus for improving the efficiency of an internal combustion engine including a filter unit connected between the crankcase and the inlet manifold of the engine. The devices of these patents are relatively complex and costly to produce and maintain and there remains a need for simplified, but unique, apparatus for separating and collecting the heavy deleterious components of crankcase emissions to improve engine efficiency and reduce air pollution.

SUMMARY OF THE INVENTION

The present invention relates to a simplified device for removing undesirable contaminants from crankcase emissions before such emissions flow through the positive crankcase ventilation (PCV) valve installed on substantially all internal combustion engines or motor vehicles.

It is an object of this invention to provide a crankcase emission separator and collector device for reducing the airborne pollutants derived from crankcase emissions of internal combustion engines and for increasing the efficiency of such engines.

It is a further object of this invention to provide a crankcase emission separator and collector device which is compact in size, inexpensive to purchase and install, and easy to maintain.

It is still a further object of this invention to provide a crankcase emission separator and collector device adapted for use on a wide variety of commercially-available automobiles and other vehicles powered by internal combustion engines and which is easily installed by the average automobile owner.

It is yet a further object of the invention to provide a crankcase emission separator and collector device which enables the PCV valve to operate at improved efficiency for extended periods of time without cleaning or replacement.

It is an additional object of the invention to provide an automobile engine pollution control device which maintains its effectiveness over long periods of time and which is mechanically simple and rugged in construction, trouble-free in operation, and of relatively small size and weight.

Briefly, the crankcase emission separator and collector device of the invention comprises a hollow housing with a separable header-cover member having an inlet conduit adapted to be coupled to the crankcase of an internal combustion engine to receive the emissions (including blow-by gases) therefrom and to discharge such emissions into the housing in the lower portion thereof. The header-cover member has an outlet conduit which is adpated to be coupled to the intake manifold of the engine. A mechanical filter assembly, carried by and supported therein by the inlet conduit, is disposed within the housing so as to be positioned between the emissions discharge end of the inlet conduit and the outlet conduit for filtering the emissions to remove heavy hydrocarbons, carbonaceous matter, dust, water, acid, sludge and other contaminants therefrom. The filtered contaminants drop to the bottom of the housing and collect thereat over an extended period of time.

The nature of the invention and other objects and advantages thereof will be more readily understood by one skilled in the art after consideration of the following detailed description taken in conjunction with the accompanying drawing.

DETAILED DESCRIPTION OF THE PREFERRED EMBODIMENT

Figure 2:
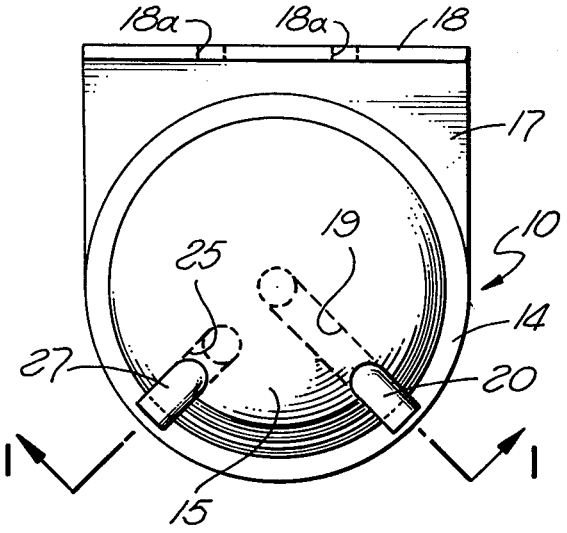
FIG. 2 is a top view of the separator and collector device of FIG. 1.
Figure 1:
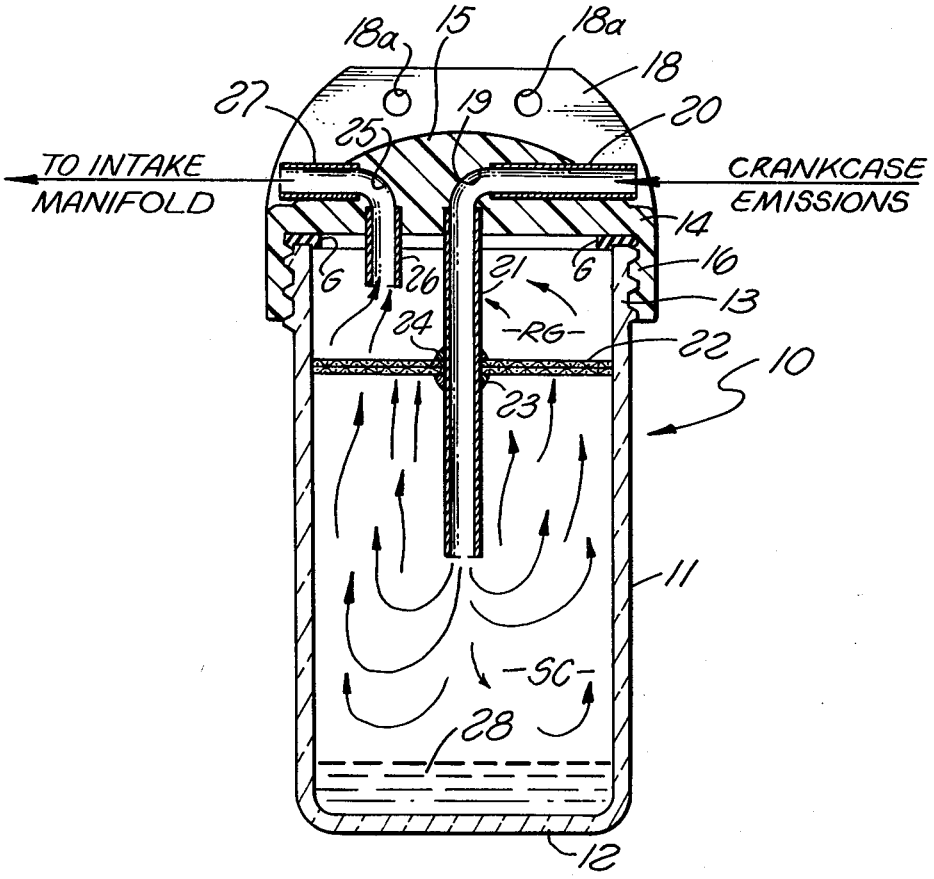
FIG. 1 is a full vertical sectional view of the crankcase emission separator and collector device in accordance with the teaching of the present invention.

Referring now to FIGS. 1 and 2 of the drawing, there is shown an automobile engine crankcase emission separator and collector device constructed in accordance with the teachings of the present invention. The separator-collector device, generally designated by the reference numeral 10, is utilized in conjunction with an internal combustion engine (not shown) of an automobile. Typical automotive engine apparatus includes an air cleaner and carburetor from which the combustible air-fuel mixture energes into an intake manifold leading to the combustion chambers of the engine. During operation of the engine a small portion of the air-fuel mixture inside the combustion chambers is forced past the piston rings of the pistons during the compression stroke just before combustion takes place and during and after combustion of the air-fuel mixture combustion exhaust gases within the combustion chambers are also forced past the piston rings. These so-called "blow-by" gases, as previously described, consist of unburned air-fuel vapors and combustion products including water, oil, carbon dioxide and carbon monoxide, and if allowed to remain in the engine's crankcase will form various types of sludges, varnish deposits, acids and other materials harmful to engine life and performance.

Before the implementation of strong efforts to control the discharge of automotive pollutants, the blow-by gases from internal combustion engines were merely vented from the crankcase to atmosphere. During the last twenty years positive crankcase ventilation (PCV) systems have been installed on most automotive engines to diminish or substantially eliminate crankcase emissions as a source of atmospheric pollutants. The separator-collector device 10 of this invention is interposed between the PCV system, and the PCV valve thereof, of the crankcase and the intake manifold of the engine. Such device comprises a cylindrical housing or separator-collector vessel 11 having a bottom wall 12. The housing and bottom wall are preferrably made of transparent material such as glass or clear plastic. The housing 11 terminates in an upper annular threaded portion 13 and such housing is provided with a circular header-cover member 14, including a dome portion 15 and a depending threaded collar 16 which interacts with threaded portion 13 of the housing to close such housing to the atmosphere. Effective sealing of the cover 14 with housing 11 may be enhanced by the interpositioning of an annular gasket G between cover 14 and the upper edge of threaded portion 13 of the housing.

The header-cover member 14 of the housing 11 is integrally formed with a mounting bracket, comprised of horizontal extension member 17 (see FIG. 2) and interconnected vertical mounting plate 18 which is attached to the engine firewall by means of appropriate fasteners extending through holes **18*a* and plate 18. The cover 14 is provided with an inlet passageway 19 which is internally threaded to receive through its external open end a threaded hose fitting 20 and which is internally threaded to receive through its internal open end an elongated threaded inlet conduit 21 which extends downwardly into the housing 11 when the header-cover member 14 is mounted on the housing. The hose fitting 20 is connected by a flexible hose (not shown) of rubber or other suitable material to the crankcase of the engine to receive crankcase emissions (including blow-by gases). The inlet conduit 21 carries a circular filter element 22 which is maintained by ring washers 23 and 24 in elevated position on the conduit within the upper one-third of housing 11 and which at its outer periphery fits snugly against the housing wall. Thus, the filter element 22, in effect, divides the housing or separator-collector vessel 11** into a lower sludge collection chamber SC and an upper recycle gas chamber RG. The filter element may be of replaceable design comprising upper and lower layers of stainless steel wire mesh with an interposed layer of cotton fiber or may be of reusable design comprising a laminated structure of three or more layers of stainless steel wire mesh. In either case the wire mesh size will range between 15 and 25 microns.

The header-cover member 14 is also provided with an outlet passageway 25 which is internally threaded to receive through its internal open end an outlet conduit 26 which extends downwardly for a relatively short distance into chamber RG of housing 11 when the cover 14 is mounted on the housing. The outlet passageway 25 is also internally threaded to receive through its external open end a threaded hose fitting 27. The hose fitting 27 is connected by a flexible hose (not shown) of suitable material to the intake manifold of the engine.

OPERATION

As indicated heretofore, the crankcase emission separator and collector device of the present invention is incorporated into the internal combustion system of an automobile by installing the device 10 between a suitable portion of the crankcase by a hose (not shown) connected to emissions inlet fitting 20 and a suitable connection on the inlet manifold by a hose (not shown) connected to outlet fitting 27. Since the pressure in the inlet manifold is generally considered to be reduced or partial vacuum, and since the pressure in the crankcase is generally considered to be substantially atmospheric, there will be gas-vapor flow through the system of the emission separtor-collector from the crankcase towards the inlet manifold.

The gas-vapor emissions mixture from the crankcase passes into the separator-collector unit through fitting 20, and passageway 19 and then pass downwardly through conduit 21 into sludge collection chamber SC of the unit. As the gas-vapor emissions mixture is withdrawn from the crankcase through the separator-collector unit, fresh air will be drawn into the crankcase through a conventional crankcase filter. The emissions mixture from the crankcase will include air, oil vapor, water vapor, gasoline vapor, blow-by gases and particles of dust, carbon, sludge, etc. The heavy impurities and components of the emissions mixture, such as water, heavy carbon, sludge, dirt and the like drip out of the mixture as such mixture leaves conduit 21 and expands into the sludge collection chamber SC, accumulating at the bottom thereof as sludge pool 28. As the emissions mixture, freed of its heaviest components, continues to expand in chamber SC it rises and passes through filter element 22 wherein the lighter impurities are intercepted and strained out and in part add to the accumulation of sludge in the bottom of chamber SC.

The strained and purified gases passing through filter element 22 collect above the filter in the upper recycle gas chamber RG, leave the emission separator-collector device 10 through outlet conduit 26, passageway 25 and outlet hose fitting 27, and pass via an interconnecting hose(not shown) to the intake manifold of the engine. The purified gas-vapor mixture admitted into the intake manifold will contain minute particles of water or water vapor. Water thus admitted into the intake manifold will be introduced into the combustion chambers of the engine forming steam which increases engine combustion efficiency and assists in reducing the formation of carbon in the cylinders. The volatile gas portion of the purified emission mixture drawn into the intake manifold strengthens or increases the combustibility of the explosive fuel mixture and thereby improves the efficiency and performance of the engine.

Through installation and use of the crankcase emission separator and collector device of this invention the normally polluting contaminants contained in the crankcase emission mixtures are effectively removed from such mixtures and accumulated as a disposable sludge in the bottom of collector housing. The thus purified crankcase emission mixture is returned to the intake manifold of the engine whereby combustible components of such purified mixture add to the air-fuel mixture supplied to the engine with the result of improved engine efficiency and engine life. Periodically, the housing or separator-collector vessel 11 of the device 10 is unscrewed from the header-cover member 14 for disposal of the sludge accumulated therein and cleaning of such vessel.

Whereas the present invention has been described in particular relation to the drawing attached hereto, it should be understood that other and further modifications, apart from those suggested herein, may be made within the spirit and scope of this invention.

What is claimed is:

1. In an internal combustion engine of the type which has a crankcase and an air-fuel manifold wherein the improvement comprises an apparatus for increasing the efficiency of said engine and reducing the concentration of air pollutants in the exhaust gases therefrom comprising:

(a) a hollow housing having a circular side wall and bottom wall and sealed at its upper end by a header-cover member having an inlet passageway in communicable connection with the crankcase of said engine to receive crankcase emissions and blow-by gases therefrom and an outlet passageway in communicable connection with the air-fuel intake manifold of said engine, the lower portion of the housing comprising a lower sludge collection chamber;

(b) an elongated inlet conduit depending downwardly from the inlet passageway of said header-cover member and communicates at its lower end with said lower sludge collection chamber above the level of any sludge therein for passage of said emissions and blow-by gases to said collection chamber for mixing and expansion therein to separate heavy impurities therefrom with deposit of same at the bottom of said chamber;

(c) a replaceable flat circular filter assembly slidably carried by said inlet conduit and spanning said housing and mating closely at its periphery with the circular side wall of said housing, thereby defining in the lower portion of the housing said lower sludge collection chamber and defining in the upper portion of the housing an upper recycle vapor chamber, said filter assembly comprising a multiplicity of layers of wire mesh intercepting and filtering the mixture of lighter crankcase emissions and blow-by gases which have been freed of heavy impurities during expansion of said crankcase emissions in said lower sludge collection chamber and passage of said mixture upwardly toward the upper recycle vapor chamber; and (d) an outlet conduit depending downwardly from the outlet passageway of said header-cover member and communicable at its lower end with the upper recycle vapor chamber of said housng for passage of the purified mixture of crankcase emissions and blow-by gases to the air-fuel intake manifold.

2. Apparatus for use with an internal combustion engine as claimed in claim 1 wherein the filter assembly carried by the inlet conduit comprises a multiplicity of layers of stainless steel wire mesh, each of said wire mesh layers having a mesh size range of between 15 and 25 microns.

* * * * *